US005893789A

United States Patent [19]

Wu

[11] Patent Number: 5,893,789

[45] Date of Patent: Apr. 13, 1999

[54] SPHERE TOY

[76] Inventor: Li-Hsiung Wu, No.28, Alley 171, San Min Road, Lu Zhou City, Taipei Hsien, Taiwan

[21] Appl. No.: 09/007,231

[22] Filed: Jan. 15, 1998

[51] Int. Cl.[6] ..... A63H 33/26

[52] U.S. Cl. ..... 446/129; 446/267; 40/426

[58] Field of Search ..... 446/129, 133, 446/267, 409, 418, 337, 321; 434/301; 40/426

[56] References Cited

U.S. PATENT DOCUMENTS 4,822,044 4/1989 Perkitny ..... 446/129

FOREIGN PATENT DOCUMENTS 404276286 10/1992 Japan ..... 446/129

9005570 5/1990 WIPO ..... 446/129

*Primary Examiner*—Robert A. Hafer

*Assistant Examiner*—Laura Fossum

*Attorney, Agent, or Firm*—Dougherty & Troxell

[57] ABSTRACT

A sphere toy which includes an inner spherical shell floating in a liquid inside a transparent outer spherical shell, the inner spherical shell having two contrary designs at two opposite sides and a magnetic weight at the bottom, and a rotation control device mounted on the outer spherical shell and holding a rotary knob and a magnet at the bottom of the rotary knob, the inner spherical shell being rotated with the rotary knob when the rotary knob is rotated by hand.

12 Claims, 3 Drawing Sheets

SPHERE TOY

BACKGROUND OF THE INVENTION

The present invention relates to a sphere toy, and more specifically to such a sphere toy which comprises an inner spherical shell floating in a liquid inside a transparent outer spherical shell, and a rotation control device driven to rotate the inner spherical shell in the outer spherical shell.

A variety of sphere toys have been disclosed, and have appeared on the market. Ball-in-ball is one of the most popular sphere toys nowadays. A ball-in-ball sphere toy is comprised of a small ball floated in a liquid inside a big ball. The small ball has a weight at the bottom. When the user rotates the big ball, the design on the small ball maintains immovable. This design becomes less attractive after several times in play.

SUMMARY OF THE INVENTION

A sphere toy in accordance with the present invention an annular coupling member having an annular base, a first coupling flange and a second coupling flange at two opposite sides of the annular base; a magnetic weight mounted on the annular coupling member at a bottom side thereof; an inner spherical shell, the inner spherical shell having a left hemispherical shell and a right hemispherical shell respectively coupled to the first coupling flange and second coupling flange of the annular coupling member and forming with the annular coupling a spherical shell, the left hemispherical shell and the right hemispherical shell being marked with a respective design; an outer spherical shell holding the spherical shell of the inner spherical shell and the annular coupling member on the inside; a liquid filled in the space defined within the outer spherical shell outside the inner spherical shell and the annular coupling member; and a rotation control device controlled to rotate the inner spherical shell inside the outer spherical shell, the rotation control device comprising a cap fixedly fastened to the upper hemispherical shell of the outer shell on the outside, the cap having a bottom chamber and a center through hole, a rotary knob turned in the center through hole on the cap, the rotary knob having a base received inside the bottom chamber of the cap and a rod raised from the base thereof and extended out of the center through hole on the cap, and a magnet fixedly fastened to the base of the rotary knob at a bottom side thereof and producing a magnetic force of attraction to attract the magnetic weight.

DETAILED DESCRIPTION OF THE PREFERRED EMBODIMENT

Figure 1:
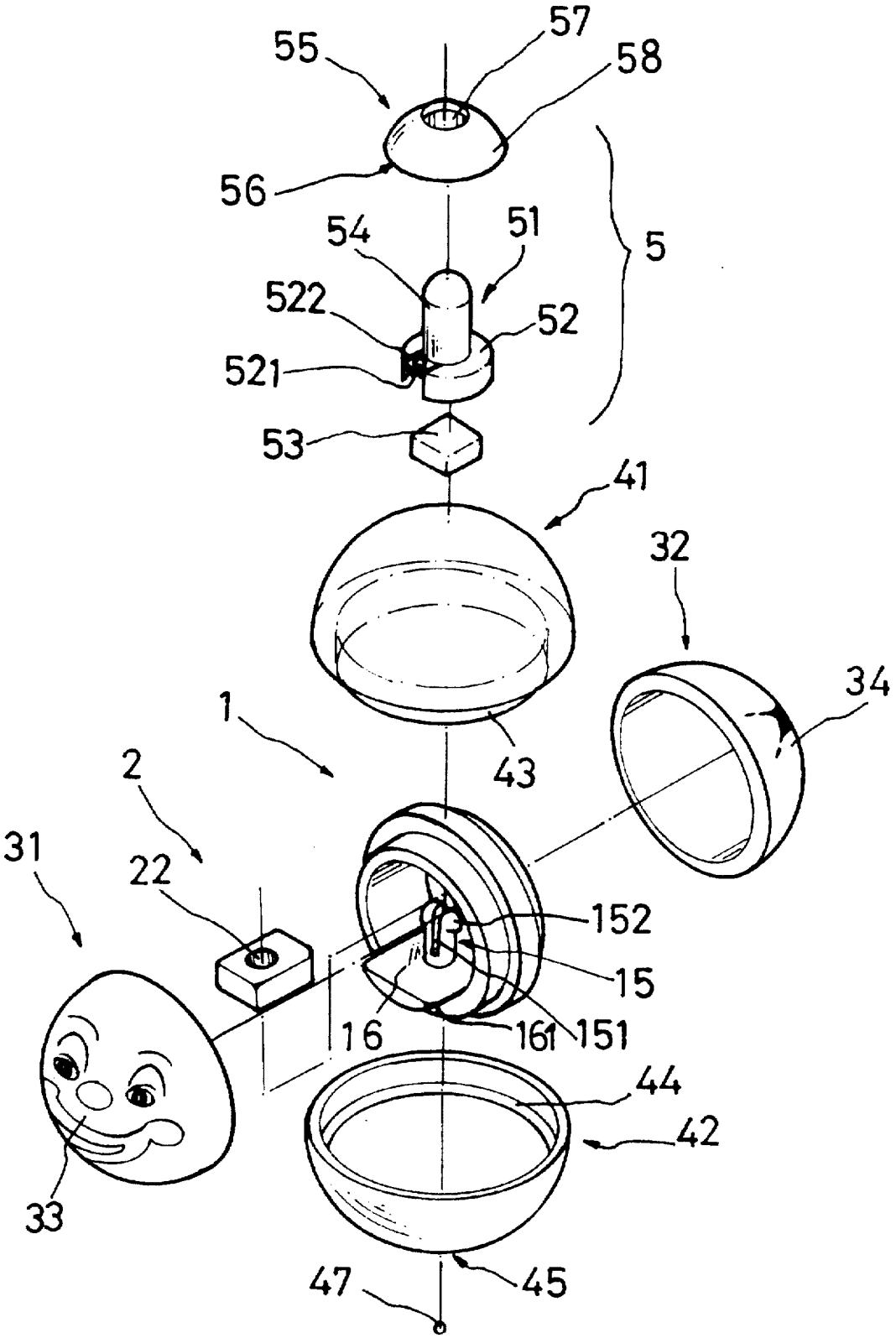
FIG. 1 is an exploded view of a sphere toy according to the present invention.
Figure 2:
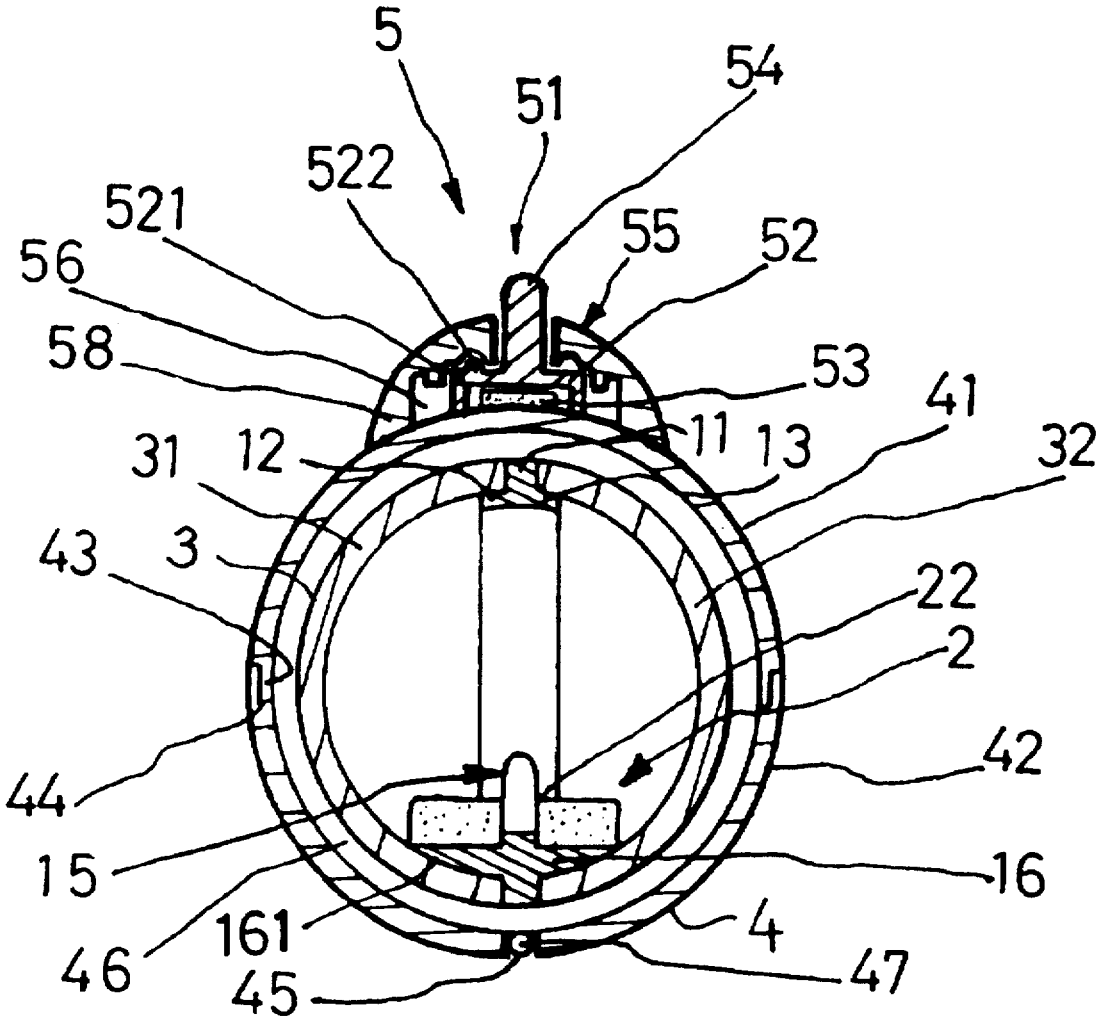
FIG. 2 is a sectional assembly view of the present invention.
Figure 3:
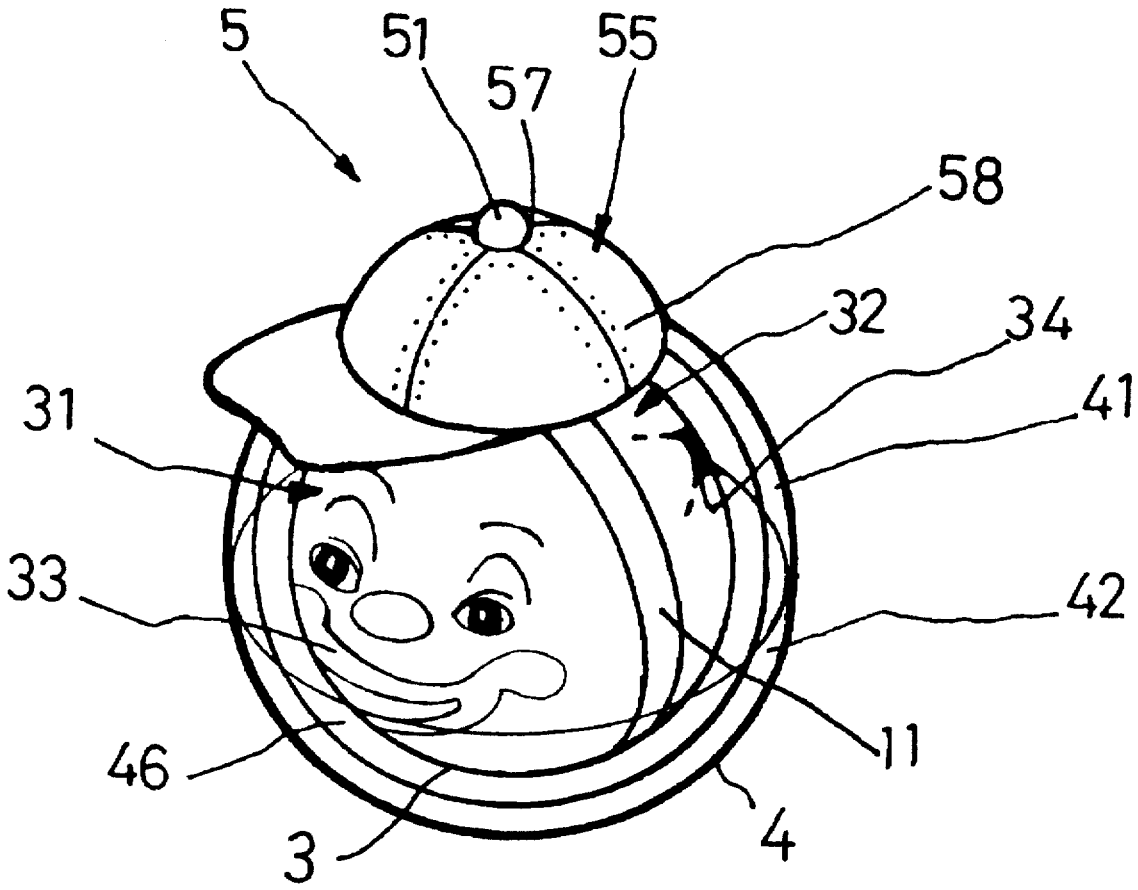
FIG. 3 is a perspective view of the present invention.

Referring to FIGS. 1, 2 and 3, a sphere toy in accordance with the present invention is generally comprised of an annular coupling member 1, a counter weight 2, an inner spherical shell 3, an outer spherical shell 4, and a rotation control device 5.

The annular coupling member 1 comprises an annular base 11, a first coupling flange 12 and a second coupling flange 13 at two opposite sides of the annular base 11 for securing the inner spherical shell 3, two coupling grooves 14 bilaterally defined between the annular base 11 and the coupling flanges 12;13, a platform 16 at the bottom side, a split bolt 15 raised from the platform 16 for holding the weight 2. The split bolt 15 is comprised of two hooked portion 152 separated by a split 151. The platform 16 has a smoothly arched bottom side 161 fits the inside wall of the hemispherical shells 31;32 of the inner spherical shell 3.

The weight 2 is made from magnetic material mounted around the split bolt 15 and carried on the platform 16 inside the annular coupling member 1, having a center hole 22 which receives the split bolt 15. After inserting the split bolt 15 into the center hole 22 on the weight 2, the weight 2 is retained to the platform 16 by the hooked portions 152 of the split bolt 15.

The inner spherical shell 3 is comprised of a left hemispherical shell 31 and a right hemispherical shell 32 respectively coupled to the coupling flanges 12;13 of the annular coupling member 1 and forced into engagement with the coupling grooves 14. Designs 33;34 are respectively provided at the hemispherical shells 31;32 on the outside. The designs 33;34 are contrary to each other, for example, one design 33 is the face of a male and the other design 34 is the face of a female; one design 33 is a crying face and the other design 34 is a smiling face.

The outer spherical shell 4 is comprised of an upper hemispherical shell 41 and a lower spherical shell 42 fastened together. The inner diameter of the outer spherical shell 4 is greater than the outer diameter of the inner spherical shell 3, so that the inner spherical shell 3 can be received inside the outer spherical shell 4. The outer spherical shell 4 is preferably transparent so that the designs 33;34 on the inner spherical shell 3 can be seen from the outside. The lower hemispherical shell 42 has a coupling groove 44 on the inside. The upper hemispherical shell 41 has a coupling flange 43 fitted into the coupling groove 44 on the lower hemispherical shell 41. The lower hemispherical shell 42 has a filling hole 45. Through the filling hole 45, a liquid (hydraulic oil) 46 is fed into the outer spherical shell 4 to fill up the space which is defined within the outer spherical shell 40 outside the inner spherical shell 30. A seal ball 47 is fastened to the filling hole 45 to seal up the gap after filling of the liquid 46.

The rotation control device 5 is comprised of a rotary knob 51, the rotary knob 51 having a base 52, a cylindrical rod 54 raised from the base 52 at the center, an opening 521, and a projecting portion 522 suspending in the opening 521, a magnet 53 mounted in the base 52 of the rotary knob 51, and a cap 55 covered on the rotary knob 51. The cap 55 comprises a cap body 58, a bottom chamber 56 defined within the cap body 58 which receives the base 52 of the rotary knob 51, a center through hole 57 through the center of the cap body 58 through which the cylindrical rod 54 of the rotary knob 51 extends to the outside, and a plurality of locating holes 561 inside the bottom chamber 56 for engagement with the projecting portion 522 of the rotary knob 51. The projecting portion 522 is shifted from one locating hole 561 to another when the rotary knob 51 is rotated by hand, and a sound is produced when the projecting portion 522 passes over one locating hole 561. The cap body 58 is fixedly fastened to the periphery of the outer spherical shell 4 to hold the rotary knob 51 in place.

The aforesaid cylindrical rod 54 may be made having an eyed top end for mounting a key ring or the like. Further, the cap 55 can be made in the shape of a hat or any of a variety of designs.

Referring to FIGS. 2 and 3 again, the assembly process of the invention is outlined hereinafter. The weight 2 is mounted on the split bolt 15 and carried on the platform 16, then the hemispherical shells 31;32 of the inner spherical shell 3 are respectively fastened to the annular coupling member 1, and then the hemispherical shells 41;42 of the outer spherical shell 4 are fastened together to hold the inner spherical shell 3 on the inside, and then the seal ball 47 is fastened to the filling hole 45 after filling of the liquid 46 in the outer spherical shell 4. Further, before fastening the hemispherical shells 41;42 together, the rotation control device 5 is fastened to the upper hemispherical shell 41 of the outer spherical shell 4.

When in use, the cylindrical rod 54 is rotated by hand, causing the weight 2 to be synchronously rotated with the magnet 53 in the rotation control device 5 (due to a magnetic force of attraction produced between the weight 2 and the magnet 52), and therefore the positions of the designs 33;34 are alternatively changed.

While only one embodiment of the present invention has been shown and described, it will be understood that various modifications and changes could be made thereunto without departing from the spirit and scope of the invention disclosed.

What the invention claimed is:

1. A sphere toy comprising:

an annular coupling member having an annular base, a first coupling flange and a second coupling flange at two opposite sides of said annular base;

a magnetic weight mounted on said annular coupling member at a bottom side thereof;

an inner spherical shell, said inner spherical shell having a left hemispherical shell and a right hemispherical shell respectively coupled to the first coupling flange and second coupling flange of said annular coupling member and forming with said annular coupling a spherical shell, said left hemispherical shell and said right hemispherical shell being marked with a respective design;

an outer spherical shell holding the spherical shell of said inner spherical shell and said annular coupling member on the inside;

a liquid filled in the space defined within said outer spherical shell outside said inner spherical shell and said annular coupling member; and a rotation control device controlled to rotate said inner spherical shell inside said outer spherical shell, said rotation control device comprising a cap fixedly fastened to said upper hemispherical shell of said outer shell on the outside, said cap having a bottom chamber and a center through hole, a rotary knob turned in the center through hole on said cap, said rotary knob having a base received inside the bottom chamber of said cap and a rod raised from the base thereof and extended out of the center through hole on said cap, and a magnet fixedly fastened to the base of said rotary knob at a bottom side thereof and producing a magnetic force of attraction to attract said magnetic weight.

2. The sphere toy of claim 1, wherein said annular coupling member comprises two coupling grooves bilaterally defined between the annular base and the coupling flanges thereof; the left hemispherical shell and right hemispherical shell of said inner spherical shell are respectively forced into engagement with the coupling grooves on said annular coupling member.

3. The sphere toy of claim 1, wherein said annular coupling member comprises a platform at the bottom side thereof, and a bolt raised from said platform for holding said magnetic weight; said magnetic weight is mounted on said bolt inside said annular coupling member and carried on said platform, having a center through hole which receives said split bolt.

4. The sphere toy of claim 3, wherein said bolt of said annular coupling member is a split bolt comprised of two hooked portion separated by a split.

5. The sphere toy of claim 3, wherein said platform has a smoothly arched bottom side fitting the inside wall of said inner spherical shell.

6. The sphere toy of claim 1, wherein the lower hemispherical shell of said outer spherical shell has a coupling groove for coupling to the upper hemispherical shell of said outer spherical shell; the upper hemispherical shell of said outer spherical shell has a coupling flange fitted into the coupling groove on the lower hemispherical shell of said outer spherical shell.

7. The sphere toy of claim 1, wherein said outer spherical shell has a filling hole through which said liquid is filled into the inside of said outer spherical shell, and a seal ball which seals said filling hole after filling of said liquid in said outer spherical shell.

8. The sphere toy of claim 1, wherein the designs on the hemispherical shells of said inner spherical shells are contrary to each other.

9. The sphere toy of claim 1, wherein the cap of said rotation control device has a plurality equiangularly spaced locating holes on the inside; the base of said rotary knob of said rotation control device has projecting portion at one side engaged into one locating hole inside said cap, said projecting portion being shifted from one locating hole on said cap to another when said rotary knob is rotated by hand, said projecting portion being rubbed against said cap to produce a sound when shifted from one locating hole on said cap to another.

10. The sphere toy of claim 1, wherein the rod of said rotary knob of said rotation control device has an eyed top end for coupling a key ring.

11. The sphere toy of claim 1, wherein said cap of said rotation control device has an ornamental design matching the designs on the hemispherical shells of said inner spherical shell.

12. The sphere toy of claim 1, wherein said outer spherical shell is transparent.

* * * * *